US011649751B2

(12) United States Patent
Cho et al.

(10) Patent No.: US 11,649,751 B2
(45) Date of Patent: May 16, 2023

(54) CONTROL DEVICE AND METHOD FOR DISCHARGING CONDENSED WATER

(71) Applicants: Hyundai Motor Company, Seoul (KR); Kia Corporation, Seoul (KR)

(72) Inventors: Cheol Hun Cho, Hwaseong-si (KR); Jay Yon Jo, Hwaseong-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/546,298

(22) Filed: Dec. 9, 2021

(65) Prior Publication Data

US 2023/0020357 A1 Jan. 19, 2023

(30) Foreign Application Priority Data

Jul. 9, 2021 (KR) ..... 10-2021-0090254

(51) Int. Cl.
*F01N 3/00* (2006.01)
*F02D 41/16* (2006.01)

(52) U.S. Cl.
CPC ..... *F01N 3/005* (2013.01); *F02D 41/16* (2013.01); *F02D 2200/602* (2013.01); *F02D 2200/70* (2013.01)

(58) Field of Classification Search
CPC .... F01N 3/005; F02D 41/16; F02D 2200/602; F02D 2200/70
See application file for complete search history.

(56) References Cited

U.S. PATENT DOCUMENTS

2008/0103667 A1* 5/2008 Suzuki ..... F02M 35/10229 701/70
2019/0010910 A1* 1/2019 Arnot ..... F02N 11/0829

FOREIGN PATENT DOCUMENTS

KR 20080028137 A 3/2008
WO WO-2011108997 A1 * 9/2011 ..... B61C 5/00

* cited by examiner

*Primary Examiner* — Joseph J Dallo
(74) *Attorney, Agent, or Firm* — Slater Matsil, LLP

(57) ABSTRACT

An embodiment control device for discharging condensed water includes a signal receiver configured to receive a power-starting off signal, a temperature receiver configured to receive outdoor air temperature information, and a controller configured to perform a condensed water discharge mode maintaining an engine under an idling condition during a preset power-starting maintenance period in response to the power-starting off signal being received by the signal receiver and the outdoor air temperature information received from the temperature receiver being equal to or lower than a set temperature value.

20 Claims, 9 Drawing Sheets

CONTROL DEVICE AND METHOD FOR DISCHARGING CONDENSED WATER

CROSS-REFERENCE TO RELATED APPLICATIONS

This application claims the benefit of Korean Patent Application No. 10-2021-0090254, filed on Jul. 9, 2021, which application is hereby incorporated herein by reference.

TECHNICAL FIELD

The present disclosure relates to a control device and a control method for discharging condensed water.

BACKGROUND

In a vehicle, an engine burns fuel mixed with air to generate rotational force, and a large amount of combustion gas generated during driving of the engine is purified by an exhaust system and then released into the atmosphere.

The exhaust system of the vehicle may be configured to include an exhaust pipe through which exhaust gas discharged from the engine flows to a predetermined location in the vehicle, a catalytic converter connected to the exhaust pipe to remove harmful substances contained in the exhaust gas, and a muffler connected to the exhaust pipe, reducing pressure and temperature of the exhaust gas, and reducing rapid expansion of the exhaust gas and an exhaust noise.

Harmful exhaust gas discharged from the engine may be converted into water vapor (H2O), carbon dioxide (CO2), and the like in the process of being treated by the catalytic converter, and may be discharged. In this case, the water vapor may be condensed to form condensed water. Recently, as a catalyst function has been enhanced due to problems regarding an exhaust environment of a vehicle, an amount of generated condensed water has increased.

In a normal operating situation of the vehicle, the condensed water in the muffler may be discharged from the muffler externally by exhaust pressure (e.g., discharge pressure) of the exhaust gas. However, the condensed water may accumulate in the exhaust pipe and/or the muffler due to insufficient discharge of condensed water according to operating conditions of the vehicle, a layout structure of the exhaust system, parking of the vehicle on inclined ground or bottom surface, or the like.

The condensed water accumulated in the exhaust system may freeze when an outdoor air temperature is low, such as in winter, in a cold region, or the like. In particular, when a large amount of condensed water is frozen, a clogging (blockage) phenomenon in an exhaust gas flow path may occur. In this case, it may be impossible to start an engine at the time of restarting, defective starting may occur, or the exhaust system (muffler, etc.) may be deformed or damaged due to high exhaust pressure in the muffler. In particular, in a hybrid electric vehicle (HEV), since a motor driving mode in which even low-pressure exhaust gas is not discharged may be frequent, the possibility of a problem of condensed water freezing may increase.

In order to solve the problems, a method in which the condensed water is discharged by gravity through a drainage hole formed in a lower end portion (e.g., the exhaust pipe and/or the muffler) of the exhaust system in which the condensed water collects, may be used.

However, complaints may be being raised by a user because the drainage hole formed to be exposed from the exhaust system externally may be bad in appearance. Further, a user may consider such a drainage hole to be of poor quality. In addition, since condensed water flows out around the drainage hole, there may be a possibility of corrosion of components around the drainage hole, and when the drainage hole is formed in the middle of the exhaust system, there may be a problem in that it is difficult to perform tests related to measurement of exhaust gas.

SUMMARY

The present disclosure relates to a control device and a control method for discharging condensed water generated in an exhaust system of a vehicle. Particular embodiments relate to a control device and a control method for discharging condensed water, capable of controlling discharge of the condensed water when power-starting of a vehicle is turned off.

Embodiments of the present disclosure can solve problems of the prior art, and provide a control device and a control method for discharging condensed water, capable of reducing an amount of the condensed water remaining in an exhaust system, without forming a drainage hole in the exhaust system.

In addition, an embodiment of the present disclosure provides a control device and a control method for discharging condensed water, capable of preventing blockage of an exhaust pipe due to freezing of the condensed water or deformation of and damage to an exhaust system by reducing an amount of the condensed water remaining in the exhaust system.

In addition, an embodiment of the present disclosure provides a control device and a control method for discharging condensed water, capable of discharging the condensed water in a state recognized by a user under a condition in which the condensed water may freeze.

According to an embodiment of the present disclosure, a control device for discharging condensed water includes a signal receiver configured to receive a power-starting off signal; a temperature receiver configured to receive outdoor air temperature information, and a controller configured to perform a condensed water discharge mode maintaining an engine under an idling condition during a preset power-starting maintenance period in response to the power-starting off signal being received by the signal receiver and the outdoor air temperature information received from the temperature receiver being equal to or lower than a set temperature value.

In this case, the condensed water discharge mode may include an automatic discharge mode configured to control driving of the engine to idle the engine at a preset amount of discharge mode revolutions during the preset power-starting maintenance period and then to stop the engine.

The preset amount of discharge mode revolutions may be set to have a value greater than engine revolutions under the idling condition, and the preset amount of discharge mode revolutions and the power-starting maintenance period may have preset values based on a type of a vehicle. The controller may be configured to guide a progress status of the automatic discharge mode through a display unit.

In addition, the condensed water discharge mode may include a manual discharge mode configured to inform through a display unit that an accelerator pedal operation is required for discharging the condensed water. In this case, the controller may be configured to inform to operate an accelerator pedal during the preset power-starting maintenance period through the display unit in the manual discharge mode, and to inform of a progress status of the manual discharge mode through the display unit. In addition, the controller may be configured to inform of completion of discharging the condensed water through the display unit, and to stop the engine in response to the accelerator pedal operation satisfying set criteria. The controller may be configured to inform of non-discharge of or insufficient discharge of the condensed water through the display unit, and stop the engine in response to non-performance of the accelerator pedal operation during the power-starting maintenance period or in response to the accelerator pedal operation not satisfying set criteria.

The control device may further include a transmission mode check unit configured to check whether a transmission mode indicates a parking mode or a neutral mode, wherein the controller may be configured to perform the condensed water discharge mode when the power-starting off signal is received in the parking mode or the neutral mode and the outdoor air temperature information is equal to or lower than the set temperature value.

According to an embodiment of the present disclosure, a control method for discharging condensed water includes a signal receiving operation of receiving a power-starting off signal, a temperature comparison operation of comparing outdoor air temperature information with a set temperature value in response to the power-starting off signal being received, and a discharge mode performing operation of performing a condensed water discharge mode discharging condensed water of an exhaust system externally in response to the outdoor air temperature information being equal to or lower than the set temperature value, wherein the condensed water discharge mode maintains an engine under an idling condition during a preset power-starting maintenance period.

In this case, the condensed water discharge mode may include an automatic discharge mode controlling driving of the engine to idle the engine at a preset amount of discharge mode revolutions and then to stop the engine during the preset power-starting maintenance period. In this case, the discharge mode performing operation may include an operation of setting the preset amount of discharge mode revolutions and the power-starting maintenance period based on a type of a vehicle. In addition, the discharge mode performing operation may include an operation of providing a progress status of the automatic discharge mode through a display unit.

The condensed water discharge mode may include a manual discharge mode informing through a display unit that an accelerator pedal operation is required for discharging the condensed water. In this case, the discharge mode performing operation may include instructing initiation of the accelerator pedal operation during the preset power-starting maintenance period through the display unit in the manual discharge mode; and providing of a progress status of the manual discharge mode through the display unit.

BRIEF DESCRIPTION OF THE DRAWINGS

The above and other aspects, features, and advantages of embodiments of the present disclosure will be more clearly understood from the following detailed description, taken in conjunction with the accompanying drawings, in which.

DETAILED DESCRIPTION OF ILLUSTRATIVE EMBODIMENTS

Figure 1:
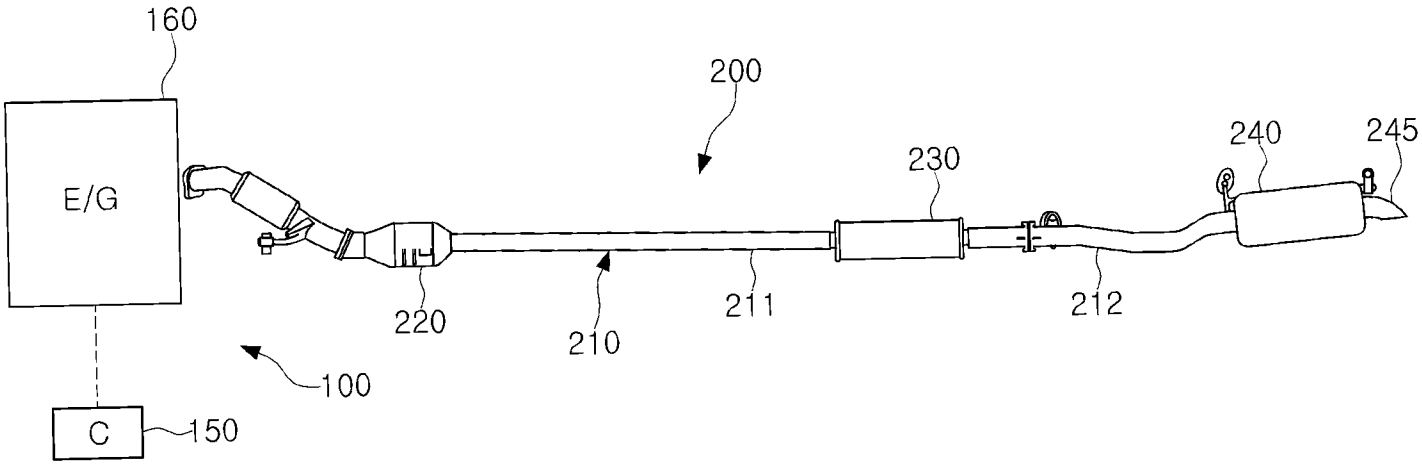
FIG. 1 is a schematic diagram illustrating an example of an exhaust system to which a control device for discharging condensed water according to an embodiment of the present disclosure is applied.

Hereinafter, embodiments of the present disclosure will be described with reference to example drawings. However, the embodiments of the present disclosure may be modified in various other forms, and a scope of the present disclosure is not limited to the embodiments described below.

In the present specification, a singular expression may include a plural expression, unless the context clearly dictates otherwise, and the same reference numerals refer to the same or corresponding elements throughout the specification. In addition, shapes and sizes of elements in the drawings may be exaggerated for clarity.

In the present specification, a vehicle refers to various vehicles that move a transported object such as a person, an animal, an object, or the like from a departure point to a destination point. Such a vehicle is not limited to a vehicle traveling on roads or tracks.

The terms "forward," "rearward," "lateral direction," "front," "rear," "above and below," "above," "upper," "upper portion," "below," "lower," "lower portion," "left and right," or the like, used in relation to direction in the description below, may be defined based on the vehicle or a body thereof. In addition, terms such as "first," "second," and the like may be used to describe various components, but these components are not limited in order, size, location, and importance by terms such as "first," "second," and the like, and one element may be named only for the purpose of distinguishing from another element.

Hereinafter, embodiments of the present disclosure will be described in detail with reference to example drawings.

First, a control device wo for discharging condensed water according to an embodiment of the present disclosure will be described with reference to FIGS. 1 to 3.

Figure 2:
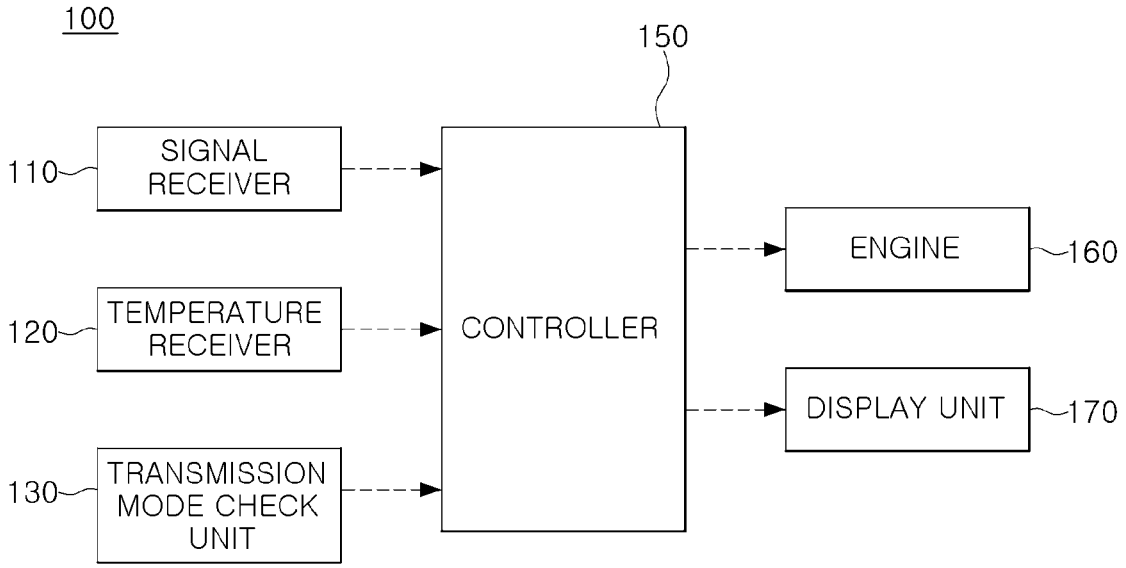
FIG. 2 is a schematic diagram illustrating a control device for discharging condensed water according to an embodiment of the present disclosure.
Figure 3:
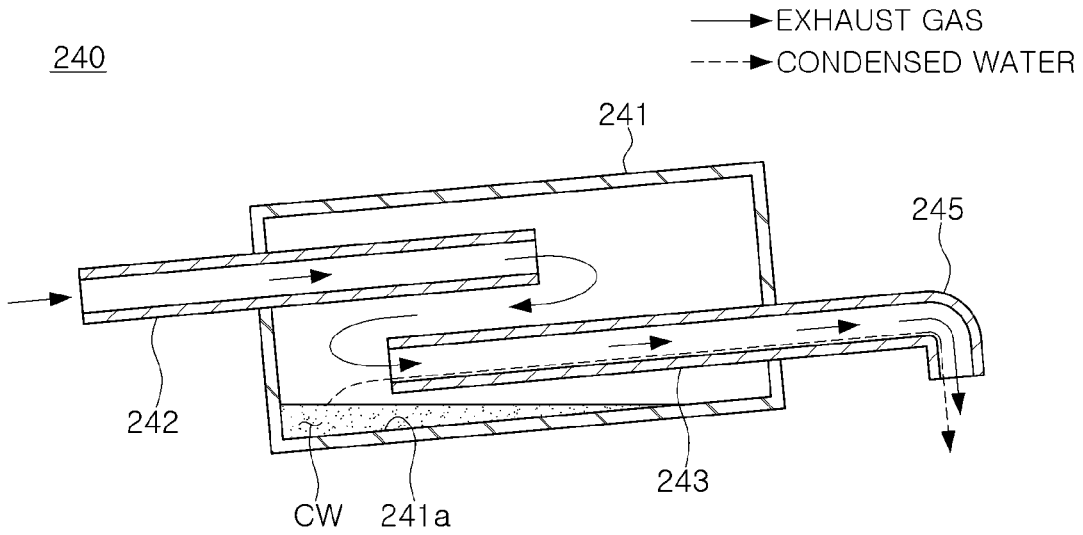
FIG. 3 is a schematic diagram illustrating a control method for discharging condensed water in a main muffler.

FIG. 1 is a schematic diagram illustrating an example of an exhaust system 200 to which a control device 100 for discharging condensed water according to an embodiment of the present disclosure is applied, FIG. 2 is a schematic diagram illustrating a control device 100 for discharging condensed water according to an embodiment of the present disclosure, and FIG. 3 is a schematic diagram illustrating a control method for discharging condensed water in a main muffler 240.

Referring to FIG. 1, an exhaust system 200 of a vehicle may include an exhaust pipe 210 allowing exhaust gas discharged from an engine 160 to flow to a predetermined position in the vehicle, a catalytic converter 220 connected to the exhaust pipe 210 and removing harmful substances included in the exhaust gas, and mufflers 230 and 240 connected to the exhaust pipe 210, reducing a pressure and a temperature of the exhaust gas, and reducing rapid expansion of the exhaust gas and exhaust noise. The mufflers 230 and 240 may include a center muffler 230 located on an upstream side of the exhaust system 200, and a main muffler 240 located on a downstream side of the exhaust system 200 and connected to a tailpipe 245.

The harmful exhaust gas (HC, CO, or the like) discharged from the engine may pass through the catalytic converter 220 and may be then converted into water vapor ($H_2O$), carbon dioxide ($CO_2$), or the like, and discharged. In this case, the water vapor may be condensed to form condensed water. In a normal operation situation, the condensed water in the main muffler 240 may be discharged from the main muffler 240 externally through the tailpipe 245 by exhaust pressure (discharge pressure) of the exhaust gas.

When discharge of the condensed water according to operating conditions of the vehicle is insufficient, the condensed water may accumulate in the exhaust system 200 such as the exhaust pipe and/or the muffler, or the like, and when an outdoor air temperature is low, the condensed water accumulated in the exhaust system 200 may freeze.

A control device wo for discharging condensed water, according to an embodiment of the present disclosure, may reduce an amount of the condensed water remaining in the exhaust system 200 by controlling driving of the engine 160 by an engine control unit (ECU) 150 to discharge the condensed water from the exhaust system 200 externally, when a power-starting off signal is received in a state corresponding to a freezing condition of the condensed water.

Referring to FIG. 2, a control device wo for discharging condensed water according to an embodiment of the present disclosure may include a signal receiver no receiving a power-starting off signal, a temperature receiver 120 receiving outdoor air temperature information, and a controller 150 controlling an engine 160 to perform a condensed water discharge mode, and may further include at least a portion of a display unit 170 configured to guide a progress status of the condensed water discharge mode to a user, or a transmission mode check unit 130 checking a transmission mode.

The signal receiver no may receive a signal, when the user presses a start button to turn on the power-starting or presses the start button again to turn off the power-starting. For example, the signal receiver no may receive an engine-on signal and a power-starting off signal.

The temperature receiver 120 may receive outdoor air temperature information of the vehicle. As an example, the temperature receiver 120 may be configured to measure an outdoor air temperature outside the vehicle or to measure an outdoor air temperature introduced into an intake manifold. The temperature receiver 120 may receive information regarding an outdoor air temperature to be expected over time through communication with the outside, as well as an outdoor air temperature, directly measured. For example, temperature information related to freezing of condensed water, such as the lowest temperature within a predetermined period (e.g., within 8 hours) corresponding to a parking period, an average temperature for a predetermined period, or the like may be received from the outside.

The transmission mode check unit 130 may be configured to check which state of a transmission mode indicates which mode. For example, the transmission mode check unit 130 may check which state of a transmission mode indicates a parking mode (a P mode), a neutral mode (an N mode), a driving mode (a D mode), and a reverse mode (an R mode).

When the power-starting off signal is input from the signal receiver no according to the user's operation of the start button, the controller 150 may determine whether discharge of the condensed water is required. When discharge of the condensed water is required, the controller 150 may perform a condensed water discharge mode discharging the condensed water in the exhaust system 200 externally.

As an example, conditions where discharge of the condensed water is required may be set when outdoor air temperature information received from the temperature receiver 120 is equal to or lower than a set temperature value. In this case, the outdoor air temperature information may include an outdoor air temperature value to be expected through communications with the outside, as well as an outdoor air temperature value measured in the vehicle.

In addition, the set temperature value may be configured to be 0° C., which may be a freezing point of water, but may be set to a temperature slightly lower than the freezing point (e.g., −2° C.) to reduce a frequent operation of the condensed water discharge mode. For example, the set temperature value may be set to a temperature (freezing point) at which the condensed water freezes, and also be set to a temperature for preventing blockage of the exhaust pipe 210 or deformation of and damage to the exhaust system 200 due to excessive freezing of the condensed water.

The condensed water discharge mode may be performed when a power-starting off signal is input and temperature information received from the temperature receiver 120 is equal to or lower than a set temperature value.

Specifically, even when a power-starting off signal is input, when temperature information received from the temperature receiver 120 is equal to or lower than a set temperature value, the condensed water discharge mode may not turn off and may maintain the power-starting of the engine 160 during a preset power-starting maintenance period without immediate stop thereof. When the condensed water discharge mode is performed while driving the engine 160, the engine 160 may be maintained under an idling condition. In a hybrid vehicle, an engine 160 may be stopped and a motor driving mode may be performed. As such, when an engine 160 is stopped and a power-starting off signal is received while driving in a motor driving mode, a condensed water discharge mode may run the engine 160 again to maintain the engine 160 under an idling condition.

In addition, since the condensed water discharge mode maintains the engine 160 under an idling condition, a transmission may be performed in the parking mode, to limit movement of the vehicle, and may also be performed in the neutral mode. Therefore, the controller 150 may be configured to perform the condensed water discharge mode when the power-starting off signal is input in the transmission mode of the parking mode or the neutral mode, and may be configured not to perform the condensed water discharge mode for safety when the power-starting off signal is input in the transmission mode of the driving mode or the reverse mode.

The condensed water discharge mode may include an automatic discharge mode actively controlling an operation of the engine 160 according to control standard (logic) input in advance to the controller 150 when a condensed water discharge condition is satisfied, and a manual discharge mode informing the user when discharge of the condensed water is required and inducing the user to operate an accelerator pedal to run the engine 160.

First, in the automatic discharge mode, the engine 160 may be controlled to idle the engine 160 at a preset amount of discharge mode revolutions during a preset power-starting maintenance period to discharge condensed water, and to then stop the engine 160. When the automatic discharge mode is completed, the engine 160 may be stopped and the power-starting may be turned off.

An amount of discharging condensed water may increase when revolutions of an engine increase and a pressure of exhaust gas increases, and may increase when a period of driving the engine to discharge the condensed water increases. In addition, based on an amount of discharging condensed water, as revolutions of an engine increase, a period of driving the engine to discharge the condensed water may decrease.

Since the condensed water discharge mode (e.g., the automatic discharge mode) may be performed while the user presses a start button to end driving of the vehicle, it is desirable to complete it as soon as possible. In consideration of this, discharge mode revolutions corresponding to engine revolutions in the condensed water discharge mode may be set to have a value higher than engine revolutions under an idling condition. For example, when the engine revolutions are 1000 rpm under an idling condition in the parking mode (P) or the neutral mode (N), discharge mode revolutions for discharging condensed water may have a value of 1500 to 3000 rpm, which may be a value higher than engine revolutions under an idling condition.

In addition, the vehicle may be provided as various detailed types of vehicles, based on an exhaust amount, a fuel type, an engine specification, a hybrid method, or the like, and a residual amount of condensed water generated in the exhaust system 200 may be different, depending on a type of a vehicle. In particular, in a hybrid vehicle (HEV), since a pure motor operation mode without discharge of exhaust gas may be performed, a large amount of condensed water may remain in an exhaust system, compared to a gasoline/diesel vehicle.

Therefore, the discharge mode revolutions and the power-starting maintenance period may be changed, depending on a type of a vehicle. The discharge mode revolutions and the power-starting maintenance period for a vehicle may be determined through an experiment for a vehicle, and may be converted into data and stored in the controller 150 such as an engine control unit (ECU) or the like.

The controller 150 may be configured to perform the condensed water discharge mode according to the preset amount of discharge mode revolutions and the power-starting maintenance period, depending on a type of a vehicle. In a hybrid vehicle, since a large amount of condensed water may remain in an exhaust system, compared to a gasoline/diesel vehicle, at least one of the discharge mode revolutions or the power-starting maintenance period may be set to be greater than that of the gasoline/diesel vehicle. For example, in a gasoline vehicle, the condensed water discharge mode (e.g., the automatic discharge mode) may be performed for 30 seconds at 2000 rpm in a parking mode (P), and in a hybrid vehicle, the condensed water discharge mode (e.g., the automatic discharge mode) may be performed for 60 seconds at 2500 rpm in a parking mode (P). A purpose of performing the condensed water discharge mode is to reduce a residual amount of condensed water to reduce problems caused by freezing of the condensed water, not to completely discharge condensed water remaining in the exhaust system. Therefore, the discharge mode revolutions or the power-starting maintenance period to be set, depending on a type of a vehicle, may be less than that described above.

In this manner, a control device 100 for discharging condensed water according to an embodiment of the present disclosure may be installed in common to various vehicle types by setting a preset amount of discharge mode revolutions and a preset power-starting maintenance period, depending on a type of a vehicle.

When the power-starting is not turned off immediately after the user presses a start button and the condensed water discharge mode is performed, it may be recognized as a vehicle failure. In consideration of this, the controller 150 may be configured to guide a progress status of the automatic discharge mode to the user through the display unit 170. For example, start, a progress status (lapse of the power-starting maintenance period), end, or the like of the automatic discharge mode may be displayed on an instrument panel (a cluster) (refer to FIG. 5). Since the user may recognize discharge of condensed water through such a display, it is possible to contribute convenience to the user by predicting a period in time taken until end of a condensed water discharge mode without considering erroneously a progress status of the condensed water discharge mode as a malfunction by the user.

In the manual discharge mode, when a condition for discharging condensed water is satisfied, the user may be guided through the display unit 170 that an accelerator pedal operation is required for discharging the condensed water. In the automatic discharge mode, there may be no user intervention, but in the manual discharge mode, the user's operation may be induced. Therefore, the manual discharge mode may have less resistance to the user, compared to the automatic discharge mode.

In the manual discharge mode, the controller 150 may be configured to inform the user to operate the accelerator pedal during the preset power-starting maintenance period through the display unit 170, and inform the user of a progress status of the manual discharge mode through the display unit 170. For example, the controller 150 may be configured to inform the user of an operation on the accelerator pedal (an accelerator) through the instrument panel (the cluster), and display lapse of the power-starting maintenance period (refer to FIG. 9).

In addition, when the user's operation of the accelerator pedal satisfies set criteria, the controller 150 may be configured to guide end of discharging the condensed water through the display unit 170, stop the engine, and turn off the power-starting.

In this case, the set criteria for operating the accelerator pedal may be set as whether the user has operated the accelerator pedal within the power-starting maintenance period.

Even when the user operates the accelerator pedal, when an operation period is too short or engine revolutions are too small due to operation of the accelerator pedal, the condensed water may not be sufficiently discharged. In consideration of this, the set criteria for operating the accelerator pedal may be set, based on a period for which the user operates the accelerator pedal within the power-starting maintenance period or the engine revolutions according to the operation of the accelerator pedal. For example, when the power-starting maintenance period is 30 seconds, and the user operates the accelerator pedal at 2000 rpm or more for 20 seconds or more, it may be set as satisfying the set criteria.

As described in the automatic discharge mode, even in the manual exhaust mode, the power-starting maintenance period may have a predetermined value through an experiment, depending on a type of a vehicle. For example, the controller 150 may guide through the display unit 170 to perform the manual discharge mode during the preset power-starting maintenance period, depending on a type of a vehicle.

When the user does not operate the accelerator pedal at all during the power-starting maintenance period, the controller 150 may guide non-discharge of the condensed water through the display unit 170, and may stop the engine and turn off the power-starting. In addition, the controller 150 may guide insufficient discharge of the condensed water through the display unit 170, when operation of the accelerator pedal does not satisfy the set criteria, even though the user operates the accelerator pedal during the power-starting maintenance period. In this manner, the non-discharge or insufficient discharge of the condensed water may be guided to recognize possibility of freezing of the condensed water by the user. Therefore, when a condition in which the condensed water may freeze is concerned, the user may turn on the power-starting again to proceed with discharge of the condensed water.

When the power-starting maintenance period is completed, the controller 150 may be configured to guide end of discharging condensed water, non-discharge of condensed water, insufficient discharge of condensed water, or the like through the display unit 170, and stop the engine and turn off the power-starting.

Referring to FIG. 3, a process for discharging condensed water in a main muffler 240 in a condensed water discharge mode will be described.

The main muffler 240 may be connected to an inlet pipe 242 through which exhaust gas generated from an engine is introduced, and an exhaust pipe 243 discharging the exhaust gas from a vehicle externally, and a tailpipe 245 may be connected to the exhaust pipe 243. A baffle (not illustrated) dividing an inner space of a muffler housing 241 into a plurality of chambers may be installed in the main muffler 240, and a metal carrier having an oxidation catalyst and a filter may be provided, but a structure of the main muffler 240 is schematically illustrated in FIG. 3.

When the condensed water discharge mode is performed, the condensed water remaining on a bottom surface 241*a* of the muffler housing 241 may be sucked into the exhaust pipe 243 by a flow rate of the exhaust gas, and may be discharged externally, together with the exhaust gas. An amount of discharging such condensed water may increase, as engine revolutions increase and a power-starting maintenance period increases.

Table 1 lists experimental data on a residual amount of condensed water, before and after performing a condensed water discharge mode. Residual amounts of condensed water in a center pipe 211, a center muffler 230, a main muffler pipe 212, and a main muffler 240, illustrated in FIG. 1, were measured before and after performing the condensed water discharge mode. The condensed water discharge mode was performed for a gasoline vehicle, and an automatic discharge mode in which idling was performed for 30 seconds (a power-starting maintenance period) at 2000 rpm (discharge mode revolutions).

As illustrated in Table 1, as results of performing the condensed water discharge mode, it was confirmed that residual amounts of condensed water in the center muffler 230 and the main muffler pipe 212, in front of the main muffler 240, as well as a residual amount of condensed water in the main muffler 240, were reduced. A total residual amount of condensed water after performing the condensed water discharge mode was reduced by approximately 82%, compared to those before performing the condensed water discharge mode.

By performing the condensed water discharge mode in this manner, a total residual amount of condensed water remaining in the exhaust system may be reduced, and thus, even when residual condensed water was frozen, various problems such as breakage of or damage to the exhaust system, poor power-starting, or the like may be remarkably overcome.

TABLE 1

| Positions for measuring Residual Amount of Condensed Water | Before performing Condensed Water Discharge Mode | After performing Condensed Water Discharge Mode |
|---|---|---|
| Center Pipe 211 | 0 ml | 0 ml |
| Center Muffler 230 | 260 ml | 30 ml |
| Main Muffler Pipe 212 | 380 ml | 80 ml |
| Main Muffler 240 | 900 ml | 170 ml |
| Total | 1540 ml | 280 ml |

Next, with reference to FIGS. 4 to 10, a control method (S100) for discharging condensed water according to an embodiment of the present disclosure will be described. A control method (S100) for discharging condensed water according to an embodiment of the present disclosure may be a method implementing a configuration of the control device 100 for discharging condensed water described with reference to FIGS. 1 to 3. Therefore, the description for the control device 100 may be applied to the control method (S100). For convenience of explanation and in order to avoid duplication of description, the control method (S100) will be briefly described, and a detailed description thereof will be replaced with the description of the control device 100.

First, an embodiment of a control method (S100) for discharging condensed water, having an automatic discharge mode, will be described with reference to FIGS. 4 to 7.

Figure 4:
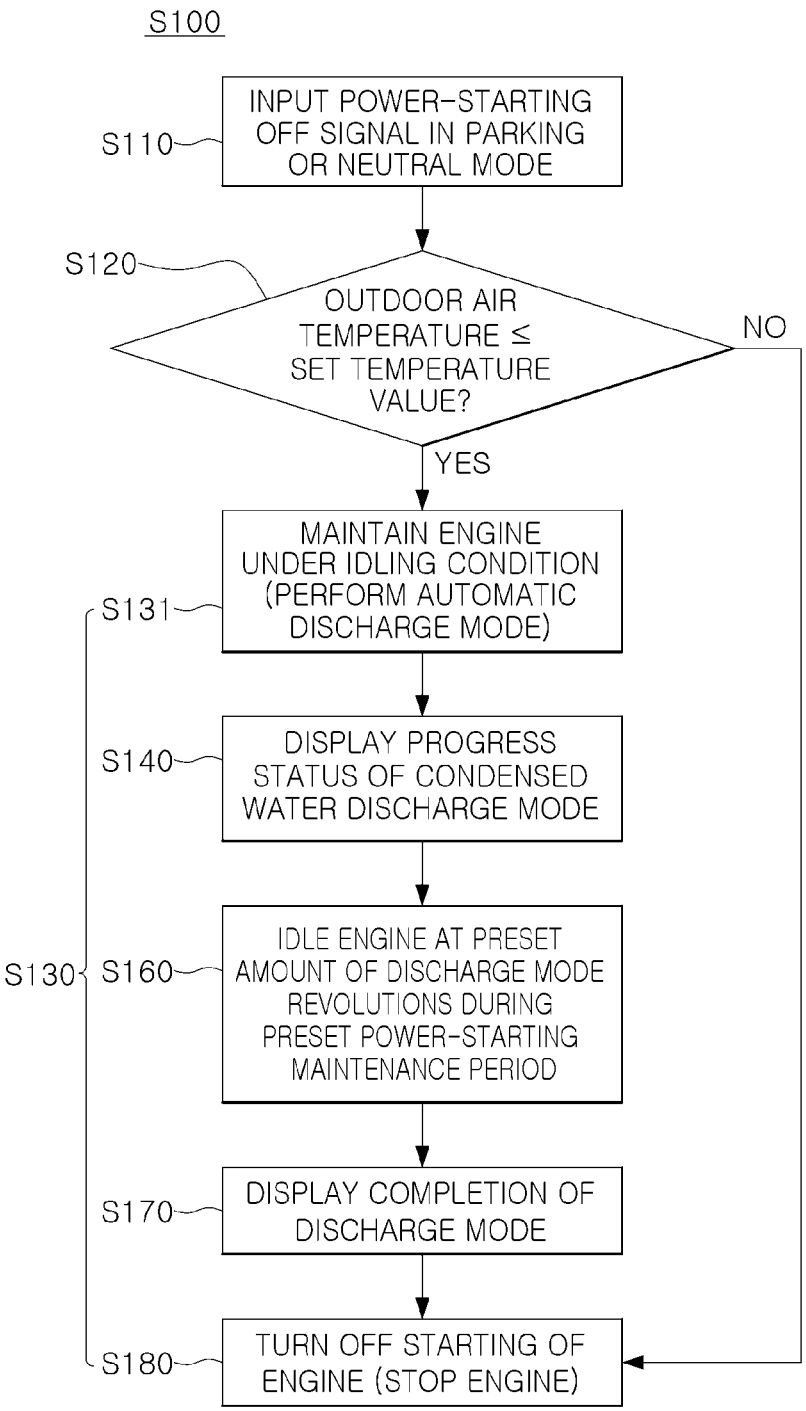
FIG. 4 is a flowchart illustrating a control method for discharging condensed water according to an embodiment of the present disclosure.
Figure 5A:
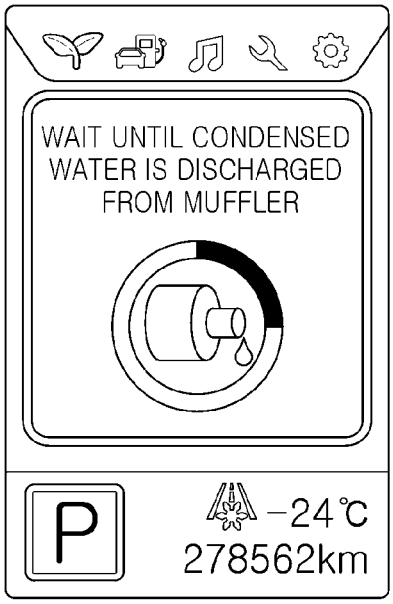
FIGS. 5A to 5C illustrate images displayed on an instrument panel to guide a progress status of a condensed water discharge mode.
Figure 5B:
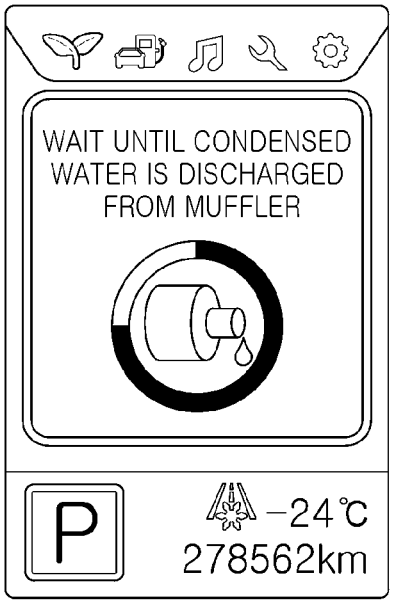
Figure 5C:
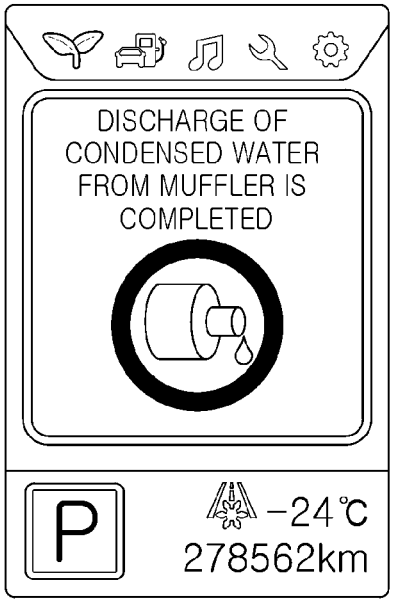
Figure 6:
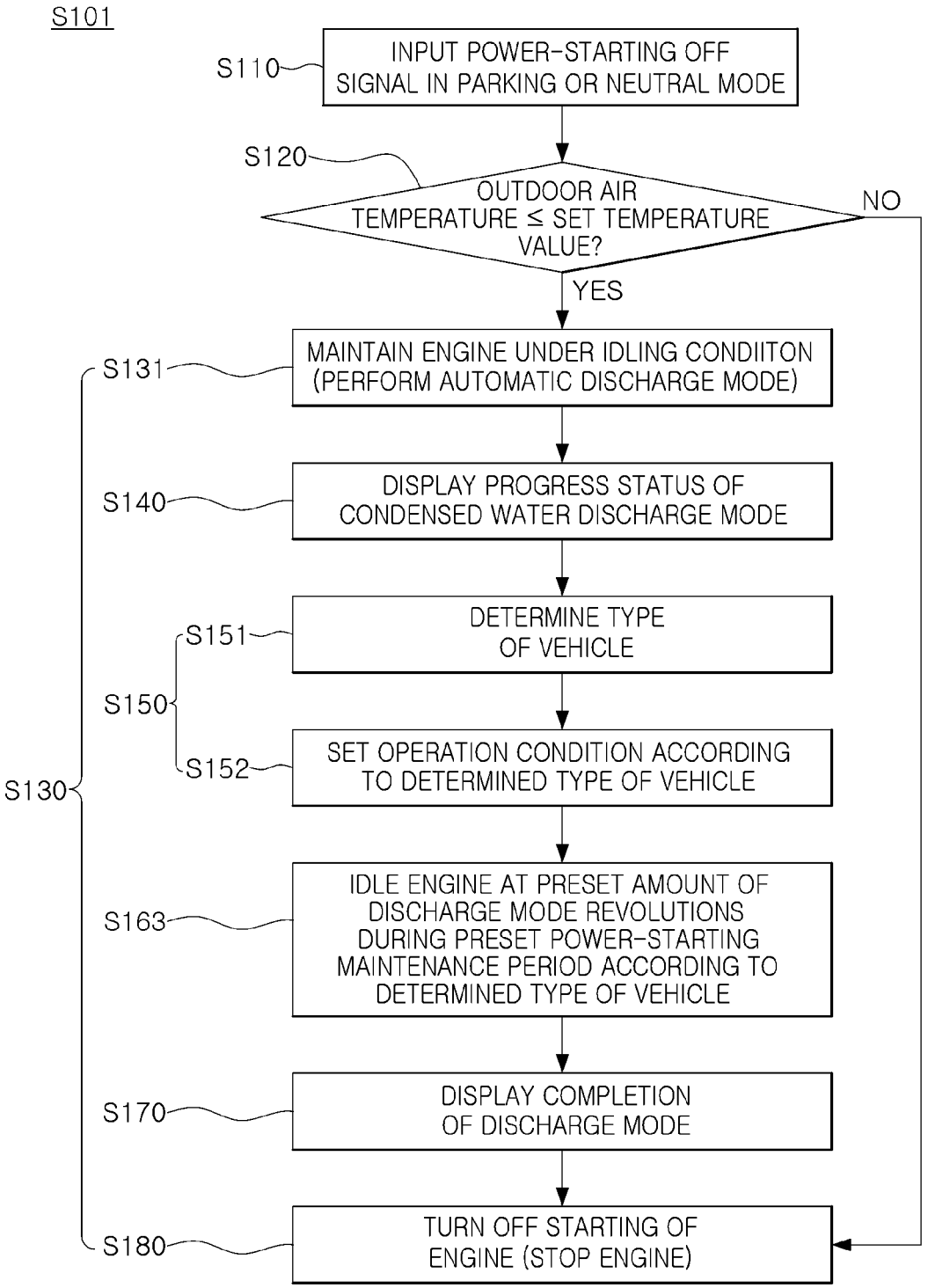
FIGS. 6 and 7 are flowcharts illustrating modified examples of the control method for discharging condensed water, illustrated in FIG. 4.
Figure 7:
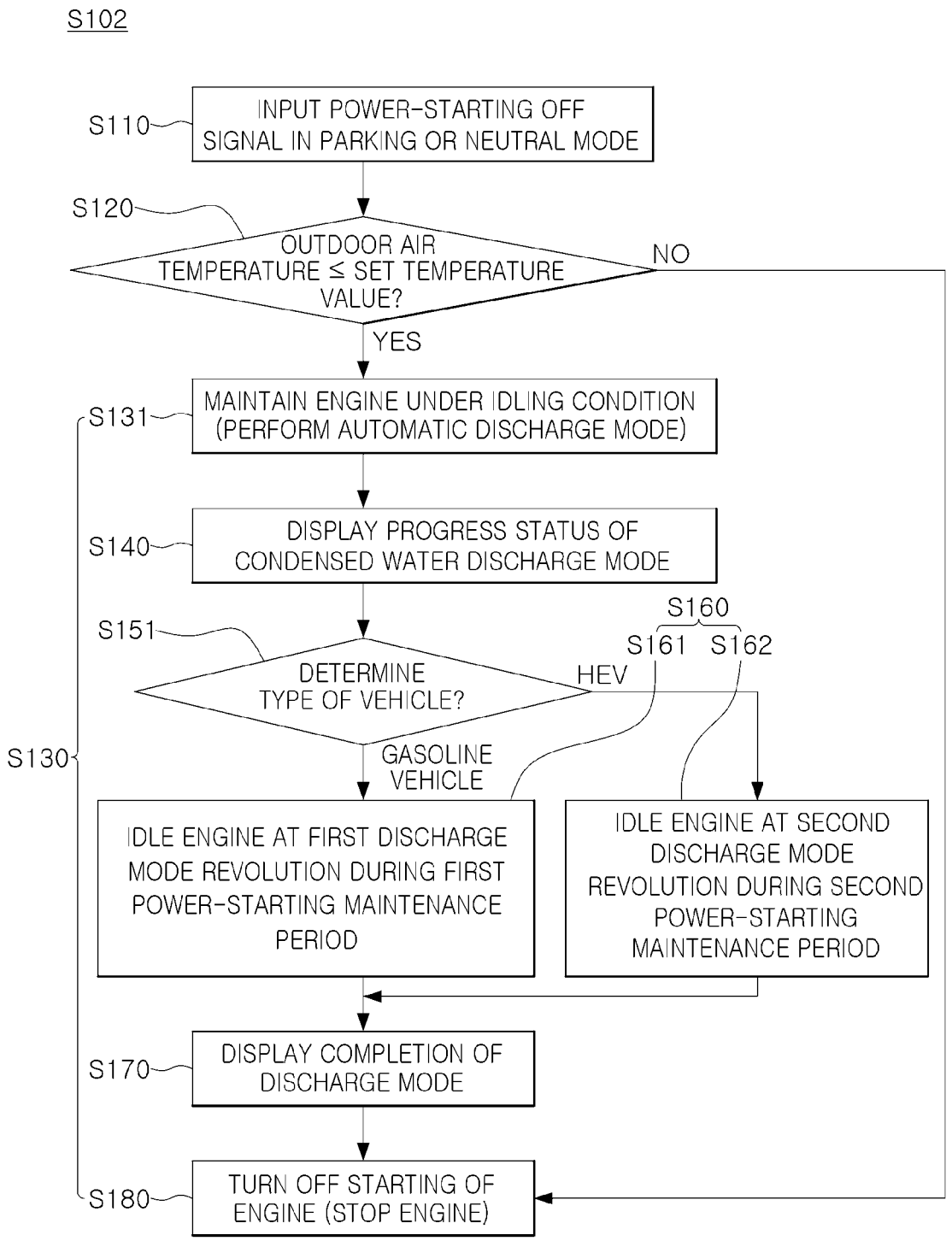

FIG. 4 is a flowchart illustrating a control method (S100) for discharging condensed water according to an embodiment of the present disclosure, FIGS. 5A to 5C illustrate images displayed on an instrument panel to guide a progress status of a condensed water discharge mode, and FIGS. 6 and 7 are flowcharts illustrating modified examples of the control method (S100) for discharging condensed water, illustrated in FIG. 4.

Referring to FIG. 4, a control method (S100) for discharging condensed water according to an embodiment may include a signal receiving operation (S110) of receiving a power-starting off signal, a temperature comparison operation (S120) of comparing outdoor air temperature information with a set temperature value, when the power-starting off signal is input, and a condensed water discharge mode performing operation (S130) of performing a condensed water discharge mode discharging condensed water of an exhaust system externally, when the outdoor air temperature information is equal to or lower than the set temperature value.

In the signal receiving operation (S110), when a user presses a start button to turn off starting of an engine (OFF), the power-starting off signal may be received. In addition, the signal receiving operation (S110) may receive information on which state of a transmission mode is indicated, and when the power-starting off signal is received in a parking mode (a P mode) or a neutral mode (an N mode), the temperature comparison operation (S120) will proceed.

In the temperature comparison operation (S120), when the power-starting off signal is input, the outdoor air temperature information may be compared with the set temperature value, to determine whether discharge of the condensed water is required. The outdoor air temperature information may be configured to measure an outdoor air temperature outside the vehicle or to measure an outdoor air temperature flowing into an intake manifold. The outdoor air temperature information may be obtained by receiving an outdoor air temperature value to be expected over time through communications with the outside, as well as an outdoor air temperature value directly measured.

The set temperature value may be set to be 0° C., which may be a temperature (e.g., a freezing point) at which the condensed water freezes, but is not limited thereto. For example, the set temperature value may be set to be a temperature (e.g., −2° C.) that may prevent blockage of an exhaust pipe 210 or deformation of or damage to an exhaust system due to excessive freezing of condensed water.

When the outdoor air temperature information is higher than the set temperature value, the condensed water freezing may not be a concern. Therefore, the engine may be stopped and the power-starting may be turned off (S180).

When the outdoor air temperature information is lower than the set temperature value, the condensed water discharge mode performing operation (S130) of performing a condensed water discharge mode discharging condensed water of an exhaust system externally may be performed.

The condensed water discharge mode may be performed when temperature information received from a temperature receiver 120 is equal to or lower than the set temperature value after the power-starting off signal is input.

Specifically, the condensed water discharge mode may be configured not to immediately stop the engine, when the outdoor air temperature information is equal to or lower than the set temperature value, even when the power-starting off signal is input. For example, the engine may be maintained in a state in which the power-starting is turned on, without turning off the power-starting, during a preset power-starting maintenance period. Therefore, the engine may be under an idling condition (S131).

The condensed water discharge mode may include an automatic discharge mode controlling driving of the engine to idle the engine at a preset amount of discharge mode revolutions and then stop the engine during the preset power-starting maintenance period, and FIG. 4 illustrates the condensed water discharge mode performing operation (S130) including the automatic discharge mode.

The condensed water discharge mode performing operation (S130) in the automatic discharge mode (S130) may include a process (S140) of guiding a progress status of the automatic discharge mode to the user through a display unit (170 of FIG. 2). For example, in the condensed water discharge mode performing operation (S130), start and progress of the automatic discharge mode (lapse of the preset power-starting maintenance period) may be displayed on an instrument panel (a cluster). Referring to FIG. 5, FIG. 5A and FIG. 5B illustrate a process status in which the automatic discharge mode proceeds according to flow of the preset power-starting maintenance period, through a screen of the instrument panel.

The automatic discharge mode may be configured to idle the engine according to the preset amount of discharge mode revolutions during the preset power-starting maintenance period (S160).

When the automatic discharge mode is completed, a completion state of the discharge mode may be guided to the user through the display unit (S170). As an example, a completion state of the automatic discharge mode may be displayed on the screen of the instrument panel, as illustrated in FIG. 5C. In addition, when the automatic discharge mode is completed, the engine may be stopped and the power-starting may be turned off (S180).

A control method (S101) for discharging condensed water, illustrated in FIG. 6, may have the same configuration as the control method (S100) illustrated in FIG. 4, except that an operation (S150) of determining a type of a vehicle and setting a discharge mode operation condition according to the determined type of a vehicle to change an operation of the automatic discharge mode, depending on the determined type of a vehicle, compared to the control method illustrated in FIG. 4, is further included. Therefore, in order to avoid unnecessary duplication, detailed descriptions of the same or similar configurations will be replaced with those described in FIG. 4, and only components of the different configurations will be described.

In FIG. 6, when a condensed water discharge mode proceeds, a type of a vehicle may be determined (S151), and a discharge mode operation condition may be set according to the determined type of a vehicle (S152).

Since amounts of the condensed water remaining in an exhaust system are different for a type of a vehicle, a power-starting maintenance period and a discharge mode revolution may be set differently, depending on a type of a vehicle. The discharge mode revolution and the power-starting maintenance period for a type of a vehicle may be determined through an experiment for a type of a vehicle, and may be converted into data and stored in a controller 150 such as an engine control unit (ECU) or the like. In this manner, by setting a preset amount of discharge mode revolutions and a preset power-starting maintenance period according to a type of a vehicle, the control method S101 according to an embodiment of the present disclosure may be commonly applied to various vehicle types.

When a discharge mode operation condition is set according to the determined type of a vehicle (S152), the engine may be idled at the preset amount of discharge mode revolutions during the preset power-starting maintenance period according to the vehicle model (S163), and when the automatic discharge mode is completed, a completion state of the discharge mode may be displayed (S170), and the engine may be stopped and the power-starting may be turned off (S180).

A control method (S102) for discharging condensed water, illustrated in FIG. 7, may have the same configuration as the control method (S100) illustrated in FIG. 4, except that an operation (S151) of setting an operating condition of an automatic discharge mode according to a type of a vehicle, compared to the control method (S100) illustrated in FIG. 4, is further included. Therefore, in order to avoid unnecessary duplication, detailed descriptions of the same or similar configurations will be replaced with those described in FIG. 4, and only components of the different configurations will be described.

In FIG. 7, when a condensed water discharge mode proceeds, it may be determined whether a type of a vehicle is a gasoline/diesel vehicle or a hybrid vehicle (HEV) (S151), and the condensed water discharge mode may be performed according to a discharge mode operation condition corresponding to the gasoline/diesel vehicle and the hybrid vehicle (S160). In FIG. 6, a discharge mode according to various detailed vehicle types such as an amount of exhaust gas, a type of fuel, engine specifications, or the like may be respectively set. In FIG. 7, since only discharge modes for a gasoline/diesel vehicle and a hybrid vehicle may be distinguished, a simpler configuration may be provided, compared to FIG. 6.

For example, in the gasoline/diesel vehicle, the engine may be idled at a first discharge mode revolution during a first power-starting maintenance period (S161), and in the hybrid vehicle, the engine may be idled at a second discharge mode revolution during a second power-starting maintenance period (S162).

Since the hybrid vehicle has a motor driving mode in which only a motor is driven when the engine is stopped, at least one of the second power-starting maintenance period or the second discharge mode revolution may have a value greater than the first power-starting maintenance period or the first discharge mode revolution, in consideration of the fact that an amount of condensed water generated is larger, compared to that of a gasoline/diesel vehicle.

When the automatic discharge mode is completed, a completion state of the discharge mode may be displayed (S170), and the engine may be stopped and the power-starting may be turned off (S180).

Next, an embodiment of a control method (S103) for discharging condensed water, having a manual discharge mode, will be described with reference to FIGS. 8 to 10.

Figure 8:
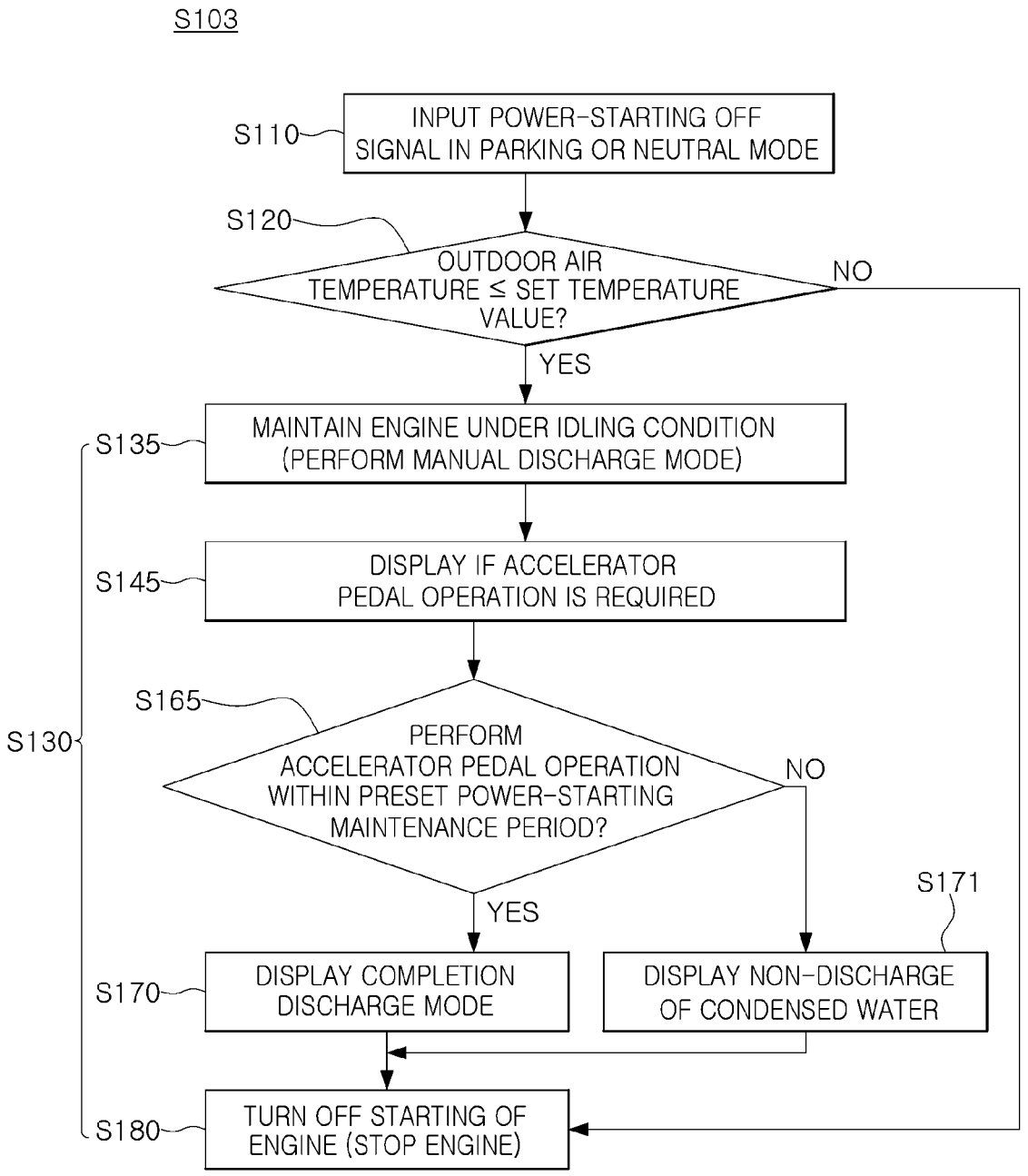
FIG. 8 is a flowchart illustrating a control method for discharging condensed water according to another embodiment of the present disclosure.
Figure 9A:
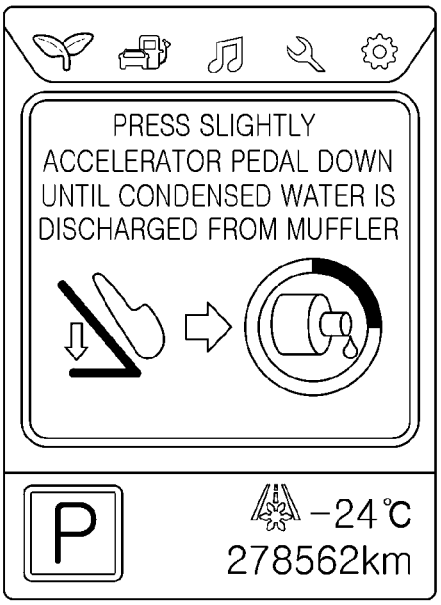
FIGS. 9A to 9D illustrate images displayed on an instrument panel to guide a progress status of a condensed water discharge mode.
Figure 9B:
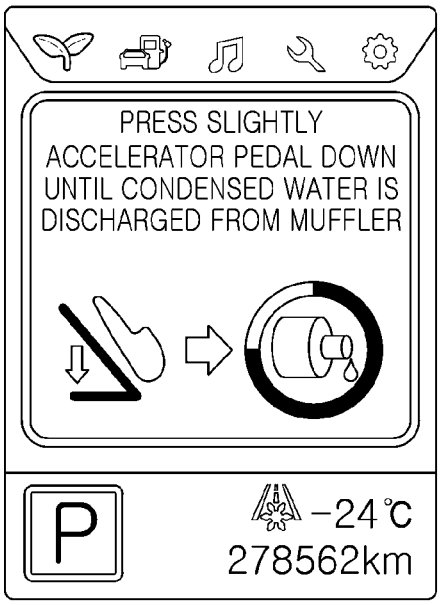
Figure 9C:
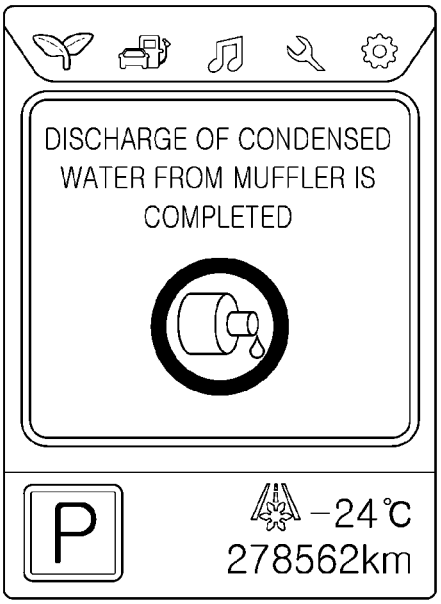
Figure 9D:
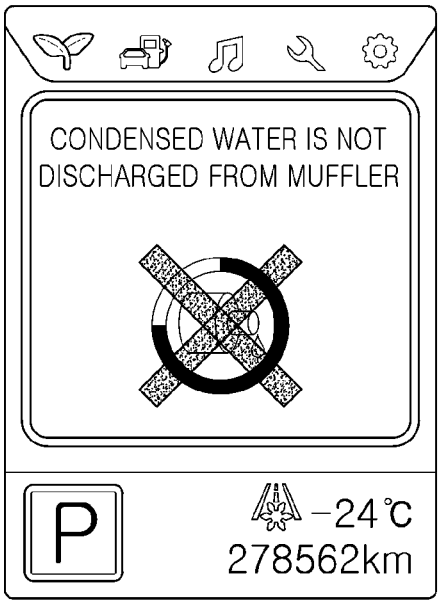
Figure 10:
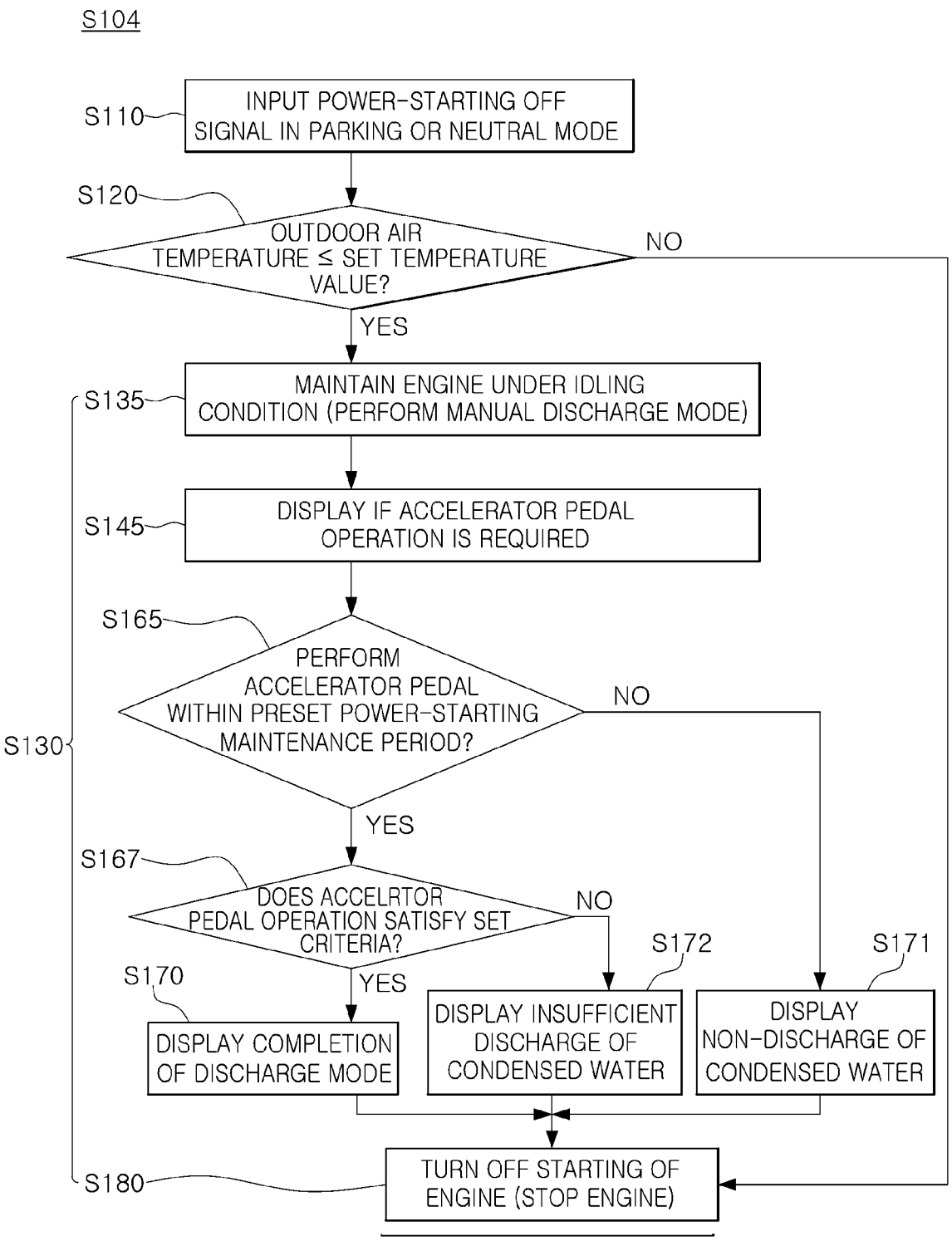
FIG. 10 is a flowchart illustrating a modified example of the control method for discharging condensed water, illustrated in FIG. 8.

FIG. 8 is a flowchart illustrating a control method (S103) for discharging condensed water according to another embodiment of the present disclosure, FIGS. 9A to 9D illustrate images displayed on an instrument panel to guide a progress status of a condensed water discharge mode, and FIG. 10 is a flowchart illustrating a modified example of the control method (S103) for discharging condensed water, illustrated in FIG. 8.

A control method (S103) for discharging condensed water, illustrated in FIG. 8, may relate to discharge of condensed water in a manual discharge mode, and may include a signal receiving operation (S110) of receiving a power-starting off signal, a temperature comparison operation (S120) of comparing outdoor air temperature information with a set temperature value, when the power-starting off signal is input, and a condensed water discharge mode performing operation (S130) of performing a condensed water discharge mode discharging condensed water of an exhaust system externally, when the outdoor air temperature information is equal to or lower than the set temperature value, similarly to the control method illustrated in FIG. 4. Since the signal receiving operation (S110) and the temperature comparison operation (S120) may be the same as in the embodiment of FIG. 4, a detailed description will be omitted and will be replaced with the above description.

In the manual exhaust mode, the engine may not stop immediately, when the outdoor air temperature information is equal to or lower than the set temperature value, even when the power-starting off signal is input, similarly to the automatic discharge mode. For example, the engine may be maintained in a state in which the power-starting is turned on, without turning off the power-starting, during a preset power-starting maintenance period. Therefore, the engine may be under an idling condition (S135).

In the manual discharge mode, a user may be guided through a display unit if an accelerator pedal operation is required for discharging the condensed water (S145). For example, as illustrated in FIGS. 9A and 9B, the accelerator pedal operation may be induced to the user, and lapse of a preset power-starting maintenance period may be displayed on an instrument panel (a cluster).

It may be determined whether the user performs the accelerator pedal operation within the preset power-starting maintenance period (S165). When the accelerator pedal operation is performed and the power-starting maintenance period has elapsed, a completion state of the manual discharge mode may be displayed, as illustrated in FIG. 9C (S170). Thereafter, the engine may be stopped and the power-starting may be turned off (S180).

When the accelerator pedal operation is not performed during the power-starting maintenance period, as illustrated in FIG. 9D, it may be displayed that the condensed water has not been discharged (S171), and the engine may be stopped and the power-starting may be turned off (S180). Since non-discharge of the condensed water may be displayed to recognize the possibility of freezing of the condensed water by the user, the user may turn on the power-starting again to proceed with discharge of the condensed water, when a condition in which the condensed water may freeze is concerned.

When the outdoor air temperature information is higher than the set temperature value in a state in which the power-starting off signal is input (S120), the engine may be stopped and the power-starting may be turned off (S180), because there is no need to discharge the condensed water.

A control method (S104) for discharging condensed water, illustrated in FIG. 10, may be different from the control method (S103) illustrated in FIG. 8, in view of the fact that the control method (S104) in FIG. 10 further includes an operation (S167) of determining if an accelerator pedal operation by a user satisfies set criteria, even when the accelerator pedal operation has been performed by the user (S165). For example, the control method (S104) in FIG. 10 may have the same configuration as the control method (S103) illustrated in FIG. 8, except that an operation (S167) of determining if an accelerator pedal operation by a user satisfies set criteria is further included. Therefore, in order to avoid unnecessary duplication, detailed descriptions of the same or similar configurations will be replaced with those described in FIG. 8, and only components of the different configurations will be described.

Even when the user performs the accelerator pedal operation, when a period of the operation is too short or engine revolutions are too low due to an accelerator pedal operation, condensed water may not be sufficiently discharged. In consideration of this, whether or not the accelerator pedal operation satisfies the set criteria may be set, based on a period in which the accelerator pedal operation is performed by the user within the power-starting maintenance period, or engine revolutions according to the accelerator pedal operation. For example, when the power-starting maintenance period is 30 seconds and the accelerator pedal operation is performed by the user at 2000 rpm or more for 20 seconds or more, it may be set as satisfying the set criteria.

When the accelerator pedal operation is performed within the power-starting maintenance period (S165) and the accelerator pedal operation satisfies the set criteria (S167), a completion state of the manual discharge mode may be displayed through the instrument panel as illustrated in FIG. 9C (S170). Even when the accelerator pedal operation is performed within the power-starting maintenance period (S165), and when the accelerator pedal operation does not satisfy the set criteria such as an insufficient period of the accelerator pedal operation and/or insufficient engine revolution, or the like (S167), the display may guide insufficient discharge of the condensed water to the user (S172), to recognize possibility of freezing of the condensed water by the user. In addition, when the accelerator pedal operation is not performed within the power-starting maintenance period, as illustrated in FIG. 9D, non-discharge of the condensed water may be displayed (S171). Thereafter, the engine may be stopped and the power-starting may be turned off (S180).

As such, in the manual discharge mode, when the user may be concerned about freezing of the condensed water by guiding non-discharge of the condensed water or insufficient discharge of the condensed water to the user, the user may be induced to turn on the power-starting again to proceed with the condensed water discharge operation.

According to an embodiment of the present disclosure having such a configuration, the condensed water may be discharged without forming a drainage hole in an exhaust system. In other words, according to an embodiment of the present disclosure, it is possible to obtain an effect of reducing an amount of the condensed water remaining in the exhaust system, by maintaining the engine under an idling condition after receiving a power-starting off signal. For example, it is possible to easily discharge the condensed water by simply changing a control method without changing a configuration of the exhaust system.

In addition, according to an embodiment of the present disclosure, it is possible to obtain an effect of preventing blockage of an exhaust pipe and deformation of or damage to an exhaust system, due to freezing of condensed water, by reducing an amount of the condensed water remaining in the exhaust system.

According to an embodiment of the present disclosure, condensed water may be discharged in a state recognized by a user under a condition in which the condensed water may freeze. Therefore, it is possible to obtain an effect of contributing convenience to the user by predicting a period of time taken until the end of a condensed water discharge mode without considering erroneously a progress status of the condensed water discharge mode as a malfunction by the user.

While example embodiments have been illustrated and described above, it will be apparent to those skilled in the art that modifications and variations could be made without departing from the scope of the present disclosure as defined by the appended claims.

In addition, in an embodiment of the present disclosure, some components may be implemented in a deleted state, and the configuration of the embodiment may be configured in combination with each other.

What is claimed is:

1. A control device for discharging remained condensed water, the control device comprising:

a signal receiver configured to receive a power-starting off signal to end an operation of a vehicle;

a temperature receiver configured to receive outdoor air temperature information; and a controller configured to perform a condensed water discharge mode maintaining an engine under an idling condition during a preset power-starting maintenance period in response to the power-starting off signal being received by the signal receiver and the outdoor air temperature information received from the temperature receiver being equal to or lower than a set temperature value, wherein the remained condensed water is present in an exhaust system of the vehicle.

2. The control device of claim 1, wherein the condensed water discharge mode comprises an automatic discharge mode configured to control driving of the engine to idle the engine at a preset amount of discharge mode revolutions during the preset power-starting maintenance period and then to stop the engine.

3. The control device of claim 2, wherein the preset amount of discharge mode revolutions is set to have a value greater than engine revolutions under the idling condition.

4. The control device of claim 2, wherein the preset amount of discharge mode revolutions and the power-starting maintenance period have preset values based on a type of the vehicle.

5. The control device of claim 2, wherein the controller is configured to guide a progress status of the automatic discharge mode through a display unit.

6. The control device of claim 1, wherein the condensed water discharge mode comprises a manual discharge mode configured to inform through a display unit that an accelerator pedal operation is required for discharging the condensed water.

7. The control device of claim 6, wherein the controller is configured to inform to operate an accelerator pedal during the preset power-starting maintenance period through the display unit in the manual discharge mode, and to inform of a progress status of the manual discharge mode through the display unit.

8. The control device of claim 7, wherein the controller is configured to inform of completion of discharging the condensed water through the display unit, and to stop the engine in response to the accelerator pedal operation satisfying set criteria.

9. The control device of claim 7, wherein the controller is configured to inform of non-discharge of or insufficient discharge of the condensed water through the display unit, and to stop the engine in response to non-performance of the accelerator pedal operation during the power-starting maintenance period or in response to the accelerator pedal operation not satisfying set criteria.

10. The control device of claim 1, further comprising a transmission mode check unit configured to check whether a transmission mode indicates a parking mode or a neutral mode, wherein the controller is configured to perform the condensed water discharge mode when the power-starting off signal is received in the parking mode or the neutral mode and the outdoor air temperature information is equal to or lower than the set temperature value.

11. A control method for discharging remained condensed water present in an exhaust system of a vehicle, the method comprising:

a signal receiving operation of receiving a power-starting off signal in order to end operation of the vehicle;

a temperature comparison operation of comparing outdoor air temperature information with a set temperature value in response to the power-starting off signal being received; and a discharge mode performing operation of performing a condensed water discharge mode discharging the condensed water of the exhaust system externally in response to the outdoor air temperature information being equal to or lower than the set temperature value, wherein the condensed water discharge mode maintains an engine under an idling condition during a preset power-starting maintenance period.

12. The method of claim 11, wherein the condensed water discharge mode comprises an automatic discharge mode controlling driving of the engine to idle the engine at a preset amount of discharge mode revolutions and then to stop the engine during the preset power-starting maintenance period.

13. The method of claim 12, wherein the discharge mode performing operation comprises an operation of setting the preset amount of discharge mode revolutions and the power-starting maintenance period based on a type of the vehicle.

14. The method of claim 12, wherein the discharge mode performing operation comprises an operation of providing a progress status of the automatic discharge mode through a display unit.

15. The method of claim 11, wherein the condensed water discharge mode comprises a manual discharge mode informing through a display unit that an accelerator pedal operation is required for discharging the condensed water.

16. The method of claim 15, wherein the discharge mode performing operation comprises:

instructing initiation of the accelerator pedal operation during the preset power-starting maintenance period through the display unit in the manual discharge mode; and providing a progress status of the manual discharge mode through the display unit.

17. A control method for discharging remained condensed water present in an exhaust system of a vehicle, the method comprising:

receiving a power-starting off signal in order to end an operation of the vehicle;

comparing outdoor air temperature information with a set temperature value in response to the power-starting off signal being received;

checking whether a transmission mode indicates a parking mode or a neutral mode; and performing a condensed water discharge mode comprising discharging the condensed water from the exhaust system to an outside in response to the power-starting off signal being received in the parking mode or the neutral mode and the outdoor air temperature information being equal to or lower than the set temperature value, wherein the condensed water discharge mode maintains an engine under an idling condition during a preset power-starting maintenance period.

18. The method of claim 17, wherein the condensed water discharge mode comprises an automatic discharge mode controlling driving of the engine to idle the engine at a preset amount of discharge mode revolutions and then to stop the engine during the preset power-starting maintenance period.

19. The method of claim 18, further comprising providing a progress status of the automatic discharge mode through a display unit.

20. The method of claim 17, wherein the condensed water discharge mode comprises a manual discharge mode in which an accelerator pedal operation is required for discharging the condensed water, the method further comprising:

instructing initiation of the accelerator pedal operation during the preset power-starting maintenance period through a display unit in the manual discharge mode; and providing a progress status of the manual discharge mode through the display unit.

* * * * *